US011292047B2

(12) United States Patent
Westbrook

(10) Patent No.: US 11,292,047 B2
(45) Date of Patent: Apr. 5, 2022

(54) MECHANICAL DIE PRESSURE MONITORING SYSTEM

(71) Applicant: Ford Global Technologies, LLC, Dearborn, MI (US)

(72) Inventor: Aaron A. Westbrook, Dearborn, MI (US)

(73) Assignee: Ford Global Technologies, Dearborn, MI (US)

( * ) Notice: Subject to any disclaimer, the term of this patent is extended or adjusted under 35 U.S.C. 154(b) by 177 days.

(21) Appl. No.: 16/402,978

(22) Filed: May 3, 2019

(65) Prior Publication Data

US 2020/0346273 A1 Nov. 5, 2020

(51) Int. Cl.
*B21D 24/14* (2006.01)
*B21D 43/02* (2006.01)

(52) U.S. Cl.
CPC ..... *B21D 43/025* (2013.01); *B21D 24/14* (2013.01)

(58) Field of Classification Search
CPC ..... B21D 22/02; B21D 24/08; B21D 24/14; B21D 37/04; B21D 37/10; B21D 37/14; B21D 43/025; B30B 1/34; B30B 1/38; B30B 15/0064; B30B 15/007; B30B 15/16; B30B 15/24; B30B 15/245; G01L 7/16; G01L 7/163; G01L 7/166; G01L 13/12; G01L 19/12; G01L 1/083; G01L 11/006; G05B 2219/37399; G05B 2219/37401; G05B 2219/45137
See application file for complete search history.

(56) References Cited

U.S. PATENT DOCUMENTS 2,821,907 A * 2/1958 Stone ..... B30B 15/0094 100/99
3,350,931 A 11/1967 Johnson et al.
3,444,718 A * 5/1969 Dennis ..... B21J 13/10 72/419
3,668,919 A * 6/1972 Hongo ..... B30B 15/007 72/453.08
4,125,010 A * 11/1978 Adam ..... B30B 15/16 72/453.06
5,138,857 A * 8/1992 Siegert ..... B21D 24/08 72/21.1
5,687,598 A * 11/1997 Kirii ..... F16F 9/26 72/21.5
6,122,952 A * 9/2000 Ashwill ..... B21D 37/10 72/404

(Continued)

FOREIGN PATENT DOCUMENTS

CN 201371186 Y 12/2009
CN 201455073 U 5/2010

(Continued)

OTHER PUBLICATIONS

Translation; DE 10331939 A1; Feb. 2005.*

*Primary Examiner* — Edward T Tolan
(74) *Attorney, Agent, or Firm* — Vincent Mastrogiacomo; Burgess Law Office, PLLC

(57) ABSTRACT

A die assembly for use with a stamping die. The die assembly having a system for monitoring a gas pressure in the stamping die. The system including first and second piston-cylinder assemblies acting on a flag block wherein movement of the flag block corresponds to a pressure change. A sensor detects a movement of the flag block.

18 Claims, 5 Drawing Sheets

(56) References Cited

U.S. PATENT DOCUMENTS

| | | | | |
|---|---|---|---|---|
| 6,408,671 | B1 * | 6/2002 | Knodler | B21D 28/002 72/332 |
| 6,520,075 | B1 * | 2/2003 | Shinoda | B30B 15/24 100/214 |
| 8,082,771 | B2 | 12/2011 | Song et al. | |
| 8,113,111 | B2 | 2/2012 | Schategger et al. | |
| 8,215,108 | B2 | 7/2012 | Hahn et al. | |
| 9,057,654 | B2 | 6/2015 | Gammon | |
| 10,549,330 | B2 * | 2/2020 | Foreman | B21D 22/02 |
| 2018/0195535 | A1 * | 7/2018 | Pegram | F16F 9/325 |

FOREIGN PATENT DOCUMENTS

| | | | | |
|---|---|---|---|---|
| CN | 202147423 | U | 2/2012 | |
| CN | 102744900 | A | 10/2012 | |
| CN | 103625001 | A | 3/2014 | |
| CN | 105057432 | A | 11/2015 | |
| CN | 106003785 | A | 10/2016 | |
| CN | 106180338 | A | 12/2016 | |
| CN | 206484944 | U | 9/2017 | |
| CN | 107243561 | A | 10/2017 | |
| CN | 108213198 | A | 6/2018 | |
| CN | 207842104 | U | 9/2018 | |
| CN | 109367113 | A | 2/2019 | |
| DE | 4114496 | A1 * | 11/1992 | B21D 24/14 |
| DE | 10331939 | A1 * | 2/2005 | B21D 24/14 |
| EP | 0035009 | A1 * | 9/1981 | B21D 1/02 |
| EP | 0974410 | A2 * | 1/2000 | B21D 24/14 |
| FR | 2758390 | A | 7/1998 | |
| JP | 6-154874 | A * | 6/1994 | B21D 5/02 |

* cited by examiner

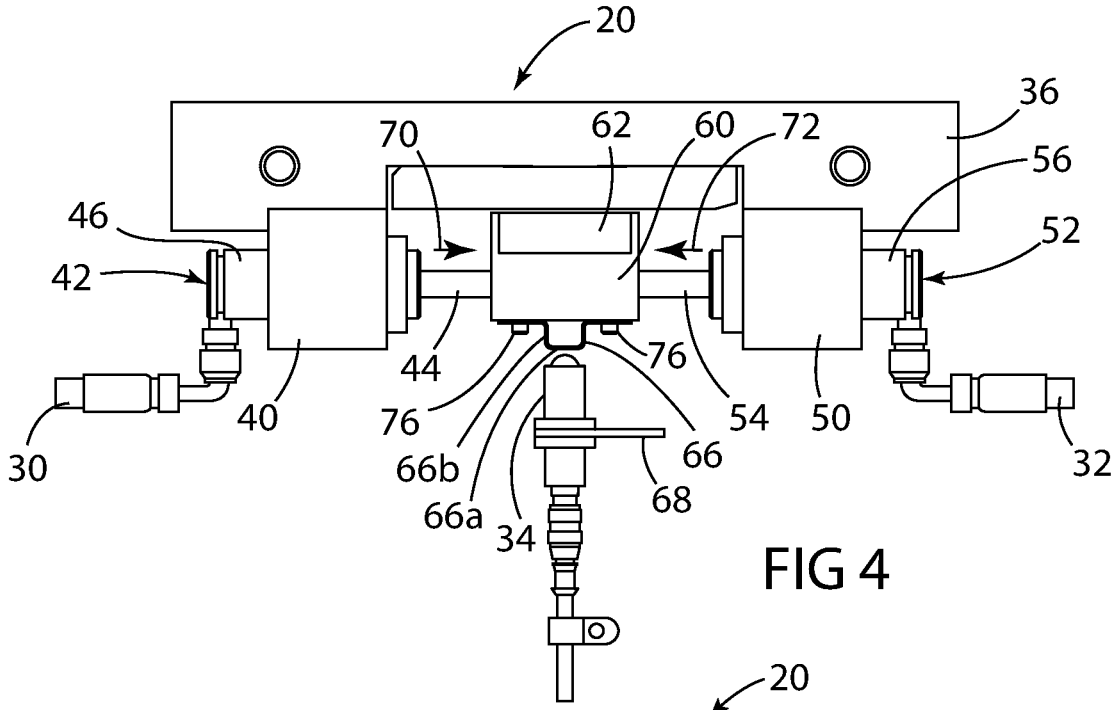
FIG 4
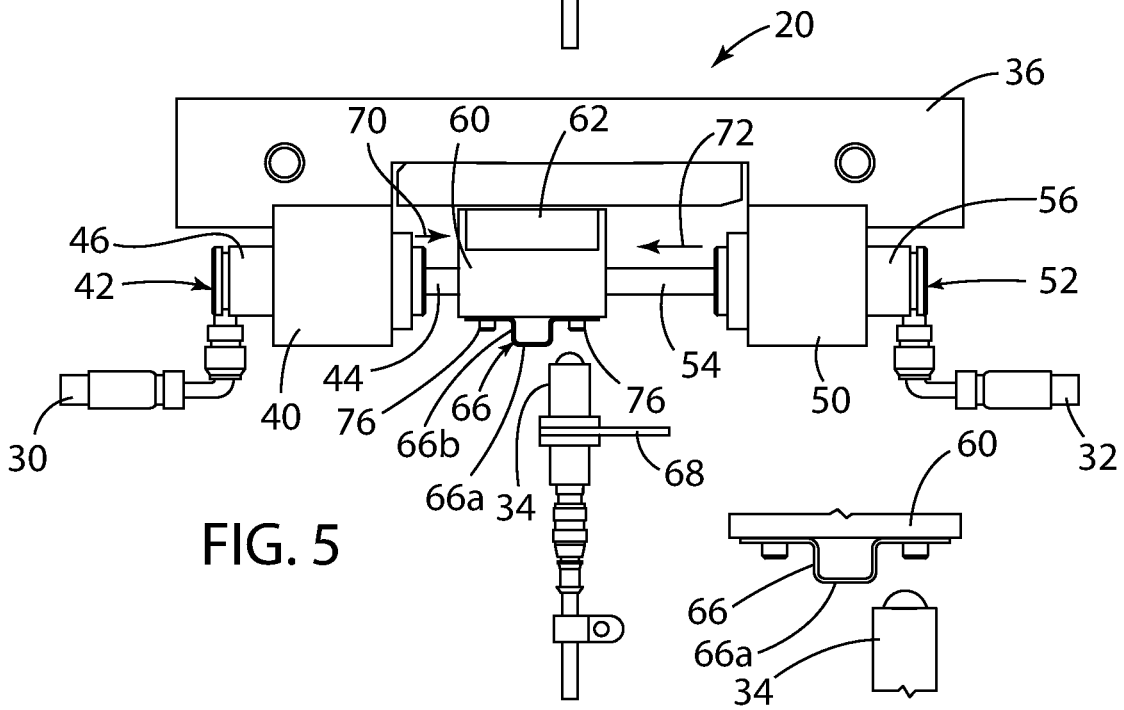
FIG. 5
FIG. 5a

MECHANICAL DIE PRESSURE MONITORING SYSTEM

CROSS-REFERENCE TO RELATED APPLICATIONS

Not Applicable.

BACKGROUND OF THE INVENTION

1. Field of the Invention

The present invention relates generally to a stamping die; and more specifically to a system for monitoring a gas pressure in a stamping die.

2. Description of Related Art

Stamping operations use compressed gas, for example, nitrogen cylinders, to move components within a die assembly. The nitrogen cylinders can be mounted in an upper die of the die assembly. Typically, the cylinders are piped together and form a piped system, enabling easy changes in system pressure. However, the piped system includes many joints each increasing the risk of leaks.

During stamping operations system operators, regardless of instruction to do so, do not always visually monitor pressure gauges during each setup cycle. If parts are run with incorrect nitrogen pressure, they rarely meet tolerance specifications. Typically, an upper die has no electrical hookup for any sensor. While wireless monitoring systems do exist, they offer minimal advantages and are not cost effective. For example, a wireless sensor may be required in a location where sensor batteries are difficult to or cannot be replaced. Pressure sensors cannot always be placed at, or in, a position where pressures need to or can be read. For example, while a pressurized hose may exist in a difficult environment—wet, rotation, and a large amount of travel, such an environment may not be conducive to sensor operation, maintenance, and use. Further, conventional sensors may not detect a small pressure drop, are expensive, or require complicated computer logic.

SUMMARY OF THE INVENTION

A die assembly including a first pressure source acting on a die component. The die assembly having a pressure monitoring system, including a first piston-cylinder assembly coupled to the first pressure source and a second piston-cylinder assembly coupled to a second pressure source. The first piston-cylinder assembly including a piston engaging a flag block and the second piston-cylinder assembly including a piston engaging the flag block. A sensor detects a movement of the flag block.

Further areas of applicability of the present invention will become apparent from the detailed description provided. It should be understood the detailed description and specific examples, while indicating an exemplary or preferred embodiment of the invention, are intended for illustration only and are not intended to limit the scope of the invention.

BRIEF DESCRIPTION OF THE DRAWINGS

The present invention will become more fully understood from the detailed description and the accompanying drawings, wherein:

FIG. 4 is a schematic side view of the mechanical pressure monitor in a first position, balanced position.

FIG. 5 is a schematic side view of the mechanical pressure monitor in a second, imbalanced position.

FIG. 5*a* is an enlarged schematic side view of a portion of the mechanical pressure monitor of FIG. 5.

DETAILED DESCRIPTION OF THE PREFERRED EMBODIMENTS

Figure 1:
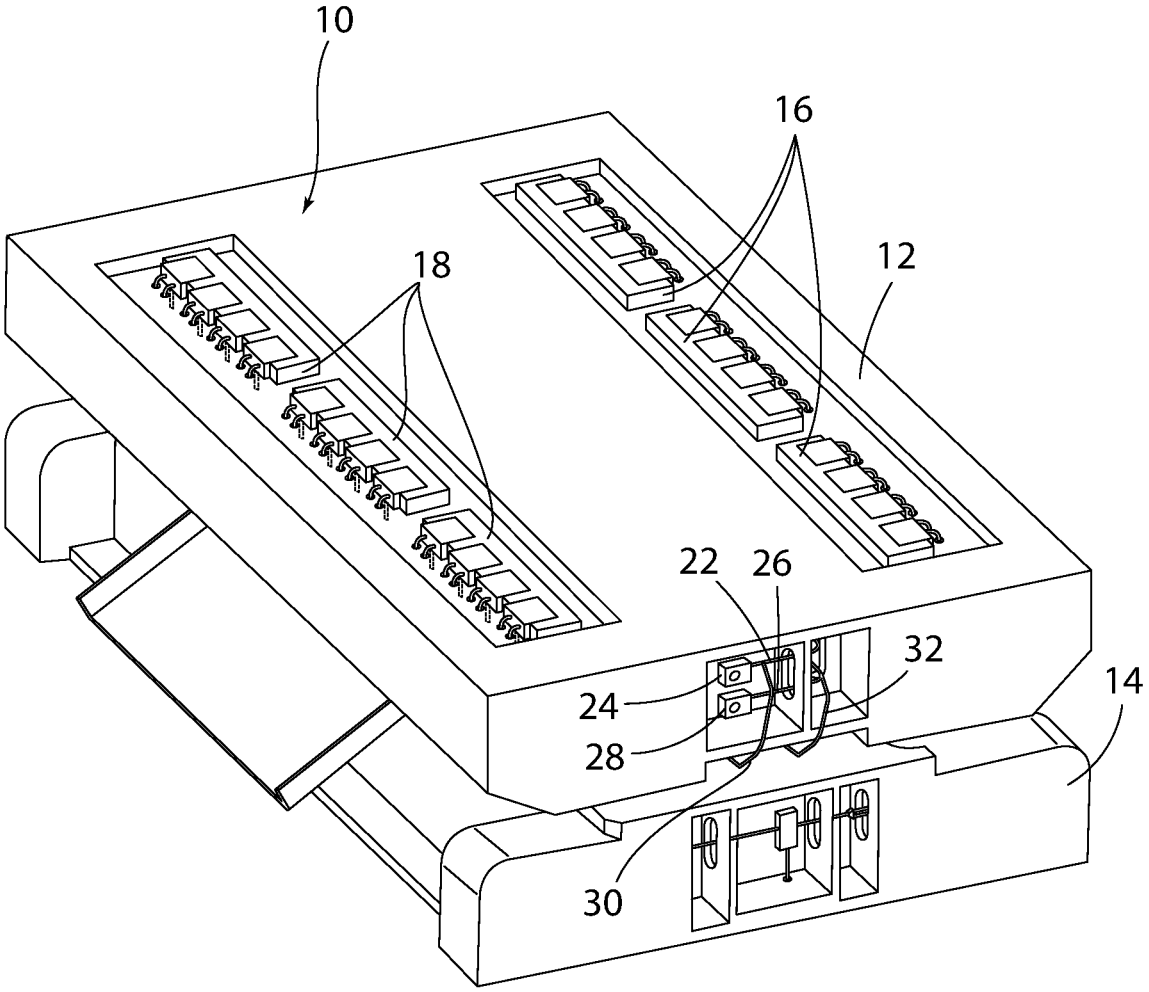
FIG. 1 is a perspective view of a die assembly.

The following description of the preferred embodiment(s) is merely exemplary in nature and is in no way intended to limit the invention, its application, or uses. In the different Figures, identical components are always given the same reference numerals, for which reason they are generally also only described once.

FIG. 1 shows a die assembly, seen generally at 10, used in a stamping operation. The die assembly 10 includes an upper die 12 and a lower die 14. FIG. 1 shows the die assembly 10 in a closed position wherein the upper die 12 and lower die 14 are positioned adjacent or next to one another. Nitrogen cylinders mounted in the upper die 12 operate to move the die components in the die assembly 10, typically when the die assembly 10 is placed in a closed position. For example, expansion and contraction of one or more of the nitrogen gas cylinders move components in the upper die 12. In the disclosed example, the nitrogen cylinders are arranged in a first cylinder array 18 and a second cylinder array 16. The cylinders of each array are piped together to easily change the system pressure. A pressure line 22 connects the first cylinder array 18 to a pressure gauge 24 and a pressure line 26 connects the second cylinder array 16 to a pressure gauge 28.

Figure 2:
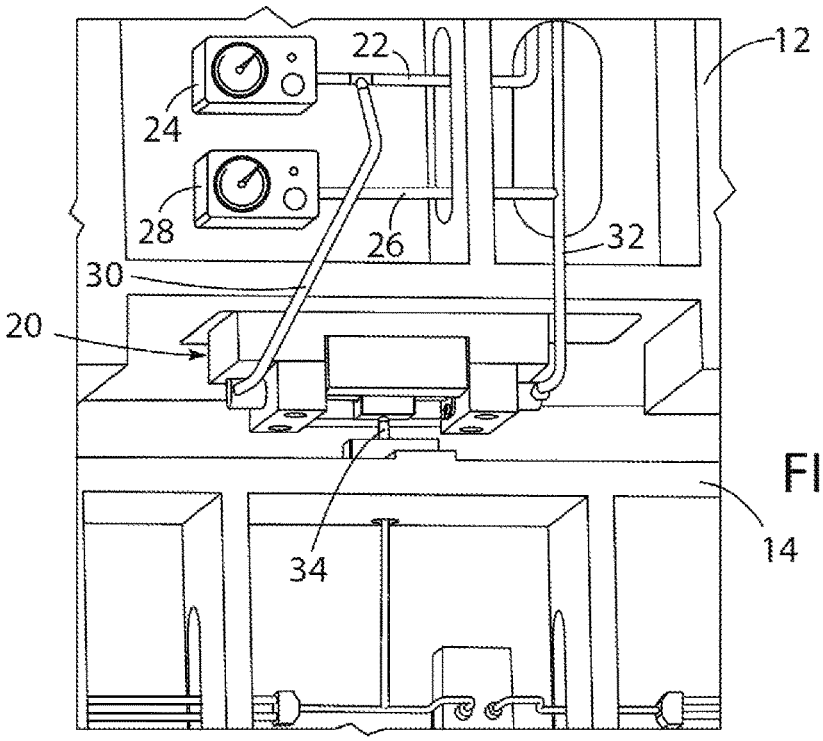
FIG. 2 is an enlarged perspective view of an end of the die assembly including a mechanical pressure monitor.

FIG. 2 shows a mechanical pressure monitoring system, seen generally at 20, mounted on the upper die 12. A first array pressure line or hose 30 connects the mechanical pressure monitoring system 20 to the first array 18 through the pressure line 22. A second array pressure line or hose 32 connects the mechanical pressure monitoring system 20 to the second array 16 through the pressure line 26. The mechanical pressure monitoring system 20 includes a sensor 34 mounted to the lower die 14.

Figure 3:
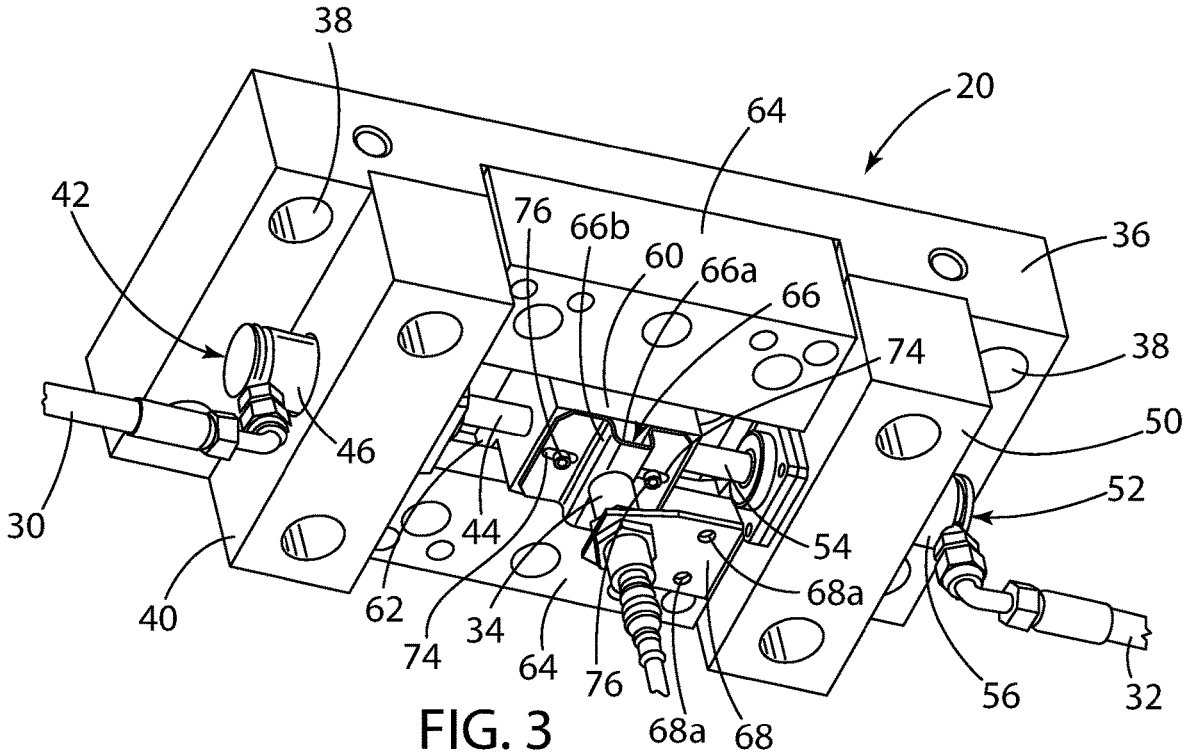
FIG. 3 is a perspective view of the mechanical pressure monitor system.

FIG. 3 illustrates the mechanical pressure monitoring system 20 including an upper die mount or base plate 36 having a plurality of apertures 38. The apertures 38 receiving fasteners or mounting bolts that secure the mechanical pressure monitoring system 20 to the upper die 12. A support block 40 supports a first piston-cylinder assembly 42, including a movable piston 44 slidably secured in a cylinder 46, on the upper die mount or base plate 36. The first array pressure line or hose 30 connects to the first piston-cylinder assembly 42 and receives pressure from the first cylinder array 18. Pressure in the cylinder 46, from the first cylinder array 18, moves or pushes the piston 44 outward. A support block 50 supports a second piston-cylinder assembly 52, including a movable piston 54 slidably secured in a cylinder 56, on the upper die mount or base plate 36. The second array pressure line or hose 32 connects to the second piston-cylinder assembly 52 and receives pressure from the second cylinder array 16. Pressure in the cylinder 56, from the second cylinder array 16, moves or pushes the piston 54 outward.

Both the piston 44 of the first piston-cylinder assembly 42 and the piston 54 of the second piston-cylinder assembly 52 act on a flag block 60. The piston 44 of the first piston-cylinder assembly 42 acts on one side of the flag block 60 and the piston 54 of the second piston-cylinder assembly 52 acts on the opposite side of the flag block 60 with the flag block 60 mounted for reciprocal movement between the support blocks 40, 50. In one example, the flag block 60 includes opposing flange portions 62 supported in respective channels or grooves formed by opposing gibs 64. The gibs 64 secured to the upper die mount or base plate 36. The flag block 60 moves laterally, for example, side to side, between the first piston-cylinder assembly 42 and the second piston-cylinder assembly 52.

The flag block 60 includes a U-shaped member or tuning flag 66 secured to it. The U-shaped tuning flag 66 includes sidewalls 66*b* connected by a base portion 66*a*. The base portion 66*a* spaced from the flag block 60. The base portion 66*a* forming the sensing object detected by the sensor 34. The width of the base portion 66*a* corresponding to the width, or sensing area of the sensor 34, with the base portion 66*a* separated from the sensor 34 at a sensing distance. The sidewalls 66*b* space the base portion 66*a* from the flag block 60 at a predetermined distance exceeding the sensing distance of the sensor 34 wherein the sensor 34 senses the tuning flag 66, specifically the base portion 66*a*, and not the flag block 60. The U-shaped tuning flag 66 includes opposing laterally extending flange or mounting portions, each having a slotted aperture 74. A bolt 76 located in each slotted aperture 74 and received in the flag block 60 provides an adjustment feature for the U-shaped tuning flag 66. For example, loosening the bolts 76 enables the U-shaped tuning flag 66 to slide laterally along the surface of the flag block 60 to position the base portion 66*a* above the sensor 34. Moving or adjusting the U-shaped tuning flag 66 compensates for any pressure difference between the respective arrays 18, 16. For example, if the pressure exerted by the respective pistons 44, 54 is not equal, the equilibrium position may result in the flag block 60 being slightly off-center, this may be compensated for by moving the U-shaped tuning flag 66.

A bracket 68, secured to the lower die 14 using apertures 68*a*, mounts the sensor 34 to the lower die 14 adjacent the tuning flag 66. While the apertures 68*a* are shown as circular, they may also be elongated slots enabling movement of the bracket 68 on the lower die 14 to further adjust the position of the sensor 34 to the U-shaped tuning flag 66. The sensor 34 is a proximity sensor that can detect nearby objects with no physical contact. In the present example, the tuning flag 66. Proximity sensors have high reliability and long functional life because of the absence of mechanical parts and lack of physical contact between the sensor and the sensed object.

FIG. 4 illustrates the mechanical pressure monitoring system 20 in equilibrium—the tuning flag 66 and flag block 60 in an equilibrium position, a centered position between the first and second piston-cylinder assemblies 42, 52 and above the sensor 34. The equilibrium position is the position of the flag block 60 between the respective piston-cylinder assemblies 42, 52 when the force 70 applied on one side of the flag block 60 by the first piston-cylinder assembly 42, and the force 72 applied on the opposite side of the flag block 60 by the second piston-cylinder assembly 52 equalize. The respective forces 70, 72 depending on the pressure in the first cylinder array 18 and the second cylinder array 16 acting on the respective first and second piston-cylinder assemblies 42, 52, with the force 70, 72 from each piston-cylinder assembly directly correlated to the pressure of the corresponding first and second cylinder array 18, 16.

When the pressure in the first cylinder array and second cylinder array 18, 16 is equal the first piston-cylinder assembly and second piston-cylinder assembly 42, 52 exert the same force 70, 72 on the flag block 60 and center the flag block 60 between them. In one example, the center position in FIG. 4 is the equilibrium position. As long as the pressure in both the first cylinder array and second cylinder array 18, 16 remains equal, the flag block 60 remains centered and stationary with the corresponding tuning flag 66 located adjacent the sensor 34.

FIG. 5 illustrates the mechanical pressure monitoring system 20 in non-equilibrium—the tuning flag 66 and flag block 60 in a non-equilibrium position spaced from the sensor 34. As shown in FIG. 4 if the pressure in both the first cylinder array and second cylinder array 18,16 remains constant or static, the flag block 60 and correspondingly the tuning flag 66 remain in a static—equilibrium position. However, if the pressure in one of the cylinder arrays 18, 16 drops, for example, a leak causing a pressure drop, the force in the associated piston-cylinder assembly 42, 52 also drops causing an imbalance in force resulting in a new equilibrium position for the flag block 60 and tuning flag 66. Displacement of the flag block 60 and tuning flag 66 from the equilibrium position triggers a fault signal via the proximity sensor 34. The difference in pressure between the first and second arrays 18, 16 moves the flag block 60 and corresponding tuning flag 66 laterally between the first and second piston-cylinder assemblies 42, 52 in the respective support blocks 40, 50. Lateral movement of the flag block 60, the side to side movement between the respective piston-cylinder assemblies 42, 52 caused by a pressure difference between the first pressure source or first array 18 and the second pressure source or second array 16 moves the tuning flag 66 wherein the proximity sensor 34 detects the movement—the change in proximity or location of the tuning flag 66 to the position of the sensor 34 mounted to the lower die 14 with the bracket 68.

Normally the first cylinder array and second cylinder array 18, 16 act symmetrically to adjust or center the flag block 60, in particular, the tuning flag 66, over or adjacent the sensor 34. However, a second symmetrical array is not required. While symmetrical cylinder arrays are not required, there must be two sources supplying input to the respective sides of the mechanical pressure monitoring system 20. There must be an input on both the left, pressure line or hose 30, and right, pressure line or hose 32, sides of the mechanical pressure monitoring system 20. If only a single cylinder array is used, for example only a first cylinder array 18, then the only input to flag block 60 is from the first piston-cylinder assembly 42 which exerts a force 70 on the flag block 60. To provide an opposite or equalizing force 72, a separate cylinder may provide an input to the second piston-cylinder assembly 52 to act against the force 70 and position the flag block 60 and tuning flag 66 adjacent the sensor 34. Typically, the cylinder providing input to the second piston-cylinder assembly 52 provides force at a pressure equal to that of the single cylinder array, for example, the first cylinder array 18. In an additional example, the second piston-cylinder assembly 52 can be configured to generate the same force 72, equal to that of the force 70 generated by the first piston-cylinder array 42, when the pressure in the cylinder connected to the second piston-cylinder array 52 differs from that of the first cylinder array 18.

Figure 6:
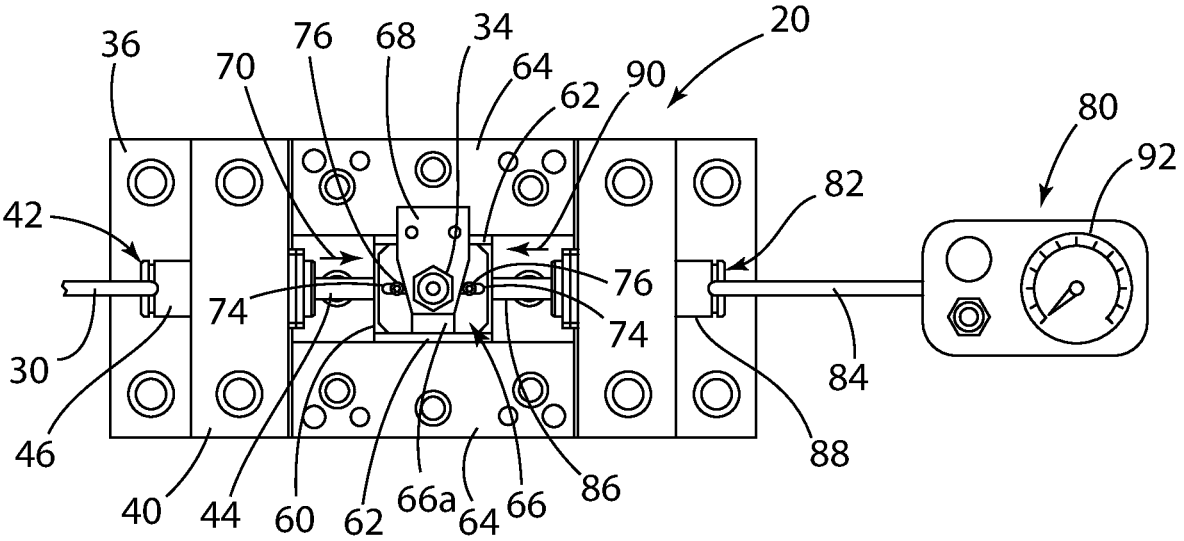
FIG. 6 is a partial bottom view of an additional embodiment of the mechanical pressure monitor system.

FIG. 6 illustrates an adjustment panel 80, used with the mechanical pressure monitoring system 20, to increase or decrease the pressure in a cylinder and position the flag block 60 in a non-symmetrical situation. An example of a non-symmetrical situation includes a single array of cylinders, for example, first cylinder array 18, wherein the input to mechanical pressure mounting system 20, from the first cylinder array 18, acts through the first piston-cylinder assembly 42 on the flag block 60 and tuning flag 66.

To balance or place the flag block 60 in equilibrium, the adjustment panel 80 is coupled to a monitor or check piston-cylinder 82, through a pressure line or hose 84. The pressure line or hose 84 applies an input to the check piston-cylinder 82 to properly position the flag block 60 and tuning flag 66. Similar to the previous embodiment, the check piston-cylinder 82 includes a piston 86 in a cylinder 88. The piston 86 applying a force 90 on the flag block 60. Using the adjustment panel 80, the force 90 of the check piston-cylinder 82 directly correlates to an adjustment panel pressure gauge 92. In one example, the adjustment panel pressure gauge 92 may be set to a target position pressure of the first cylinder array 18. The target position pressure generating the force 90 equal to the force 70 and achieving an equilibrium position of the flag block 60 that centers the flag block 60 and corresponding tuning flag 66.

Another example of a non-symmetrical situation includes a lack of symmetrical cylinder arrays, for example, second cylinder array 16 on the upper die 12 differing in size, number, or pressure than the first cylinder array 18. The adjustment panel pressure gauge 92 adjusts the pressure supplied to the check piston-cylinder 82 and correspondingly adjusts the force 90 exerted on the flag block 60. The adjustment panel 80 equalizing, through the adjustment panel pressure gauge 92, cylinder pressure between the first and second cylinder arrays 18, 16 in the upper die nitrogen system.

Figure 7:
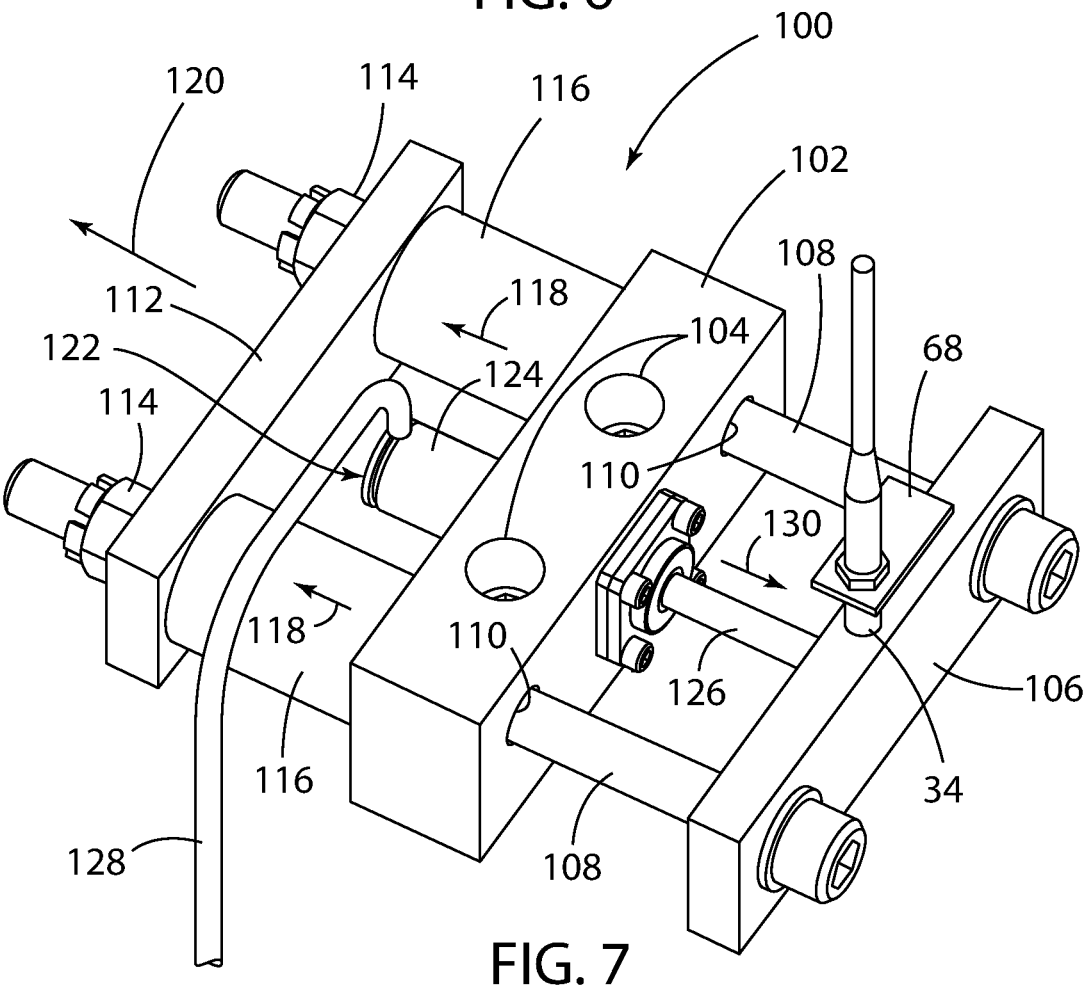
FIG. 7 is a perspective view of another embodiment of the mechanical pressure monitor system.

FIG. 7 is a bottom, perspective view of another embodiment of the mechanical pressure monitor system, seen generally at 100. The mechanical pressure monitor system 100 includes an upper die mount 102 having apertures 104 for securing the upper die mount 102 to the upper die 12. Similar to the previous embodiment, a sensor 34 is mounted on the lower die 14 with a mounting bracket 68. The sensor 34 is positioned adjacent to a flag block 106. The flag block 106 is secured to a pair of rods 108 extending through apertures 110 in the upper die mount 102. The rods 108 are secured to a spring plate 112 via fasteners 114 received on the rods 108. Springs or spring packs, seen generally at 116, positioned between the upper die mount 102 and the spring plate 112 apply a force 118 moving the spring plate 112 and correspondingly the flag block 106 in the direction of the arrow 120.

A piston-cylinder assembly 122, mounted to the upper die mount 102, includes a cylinder 124 and piston 126. The piston-cylinder assembly 122 receives pressure through a pressure line or hose 128. The pressure line or hose 128 providing a pressure input to the piston-cylinder assembly 122 wherein the piston 126 generates a force 130 acting against the force 118 of the springs 116 to properly position the flag block 106. A pressure source, for example, a pressure cylinder array similar to one of the first or second cylinder arrays 18, 16, provides pressure through the pressure in the pressure line or hose 128 to the piston-cylinder assembly 122. A drop in pressure in the cylinder array reduces the force 130 acting on the flag block 106 causing the springs 116 to move the spring plate 112 and correspondingly flag block 106 rearwardly in the direction of the arrow 120. The sensor 34 senses movement of the flag block 106 and sends a signal indicating a pressure drop in the cylinder array.

Figure 8:
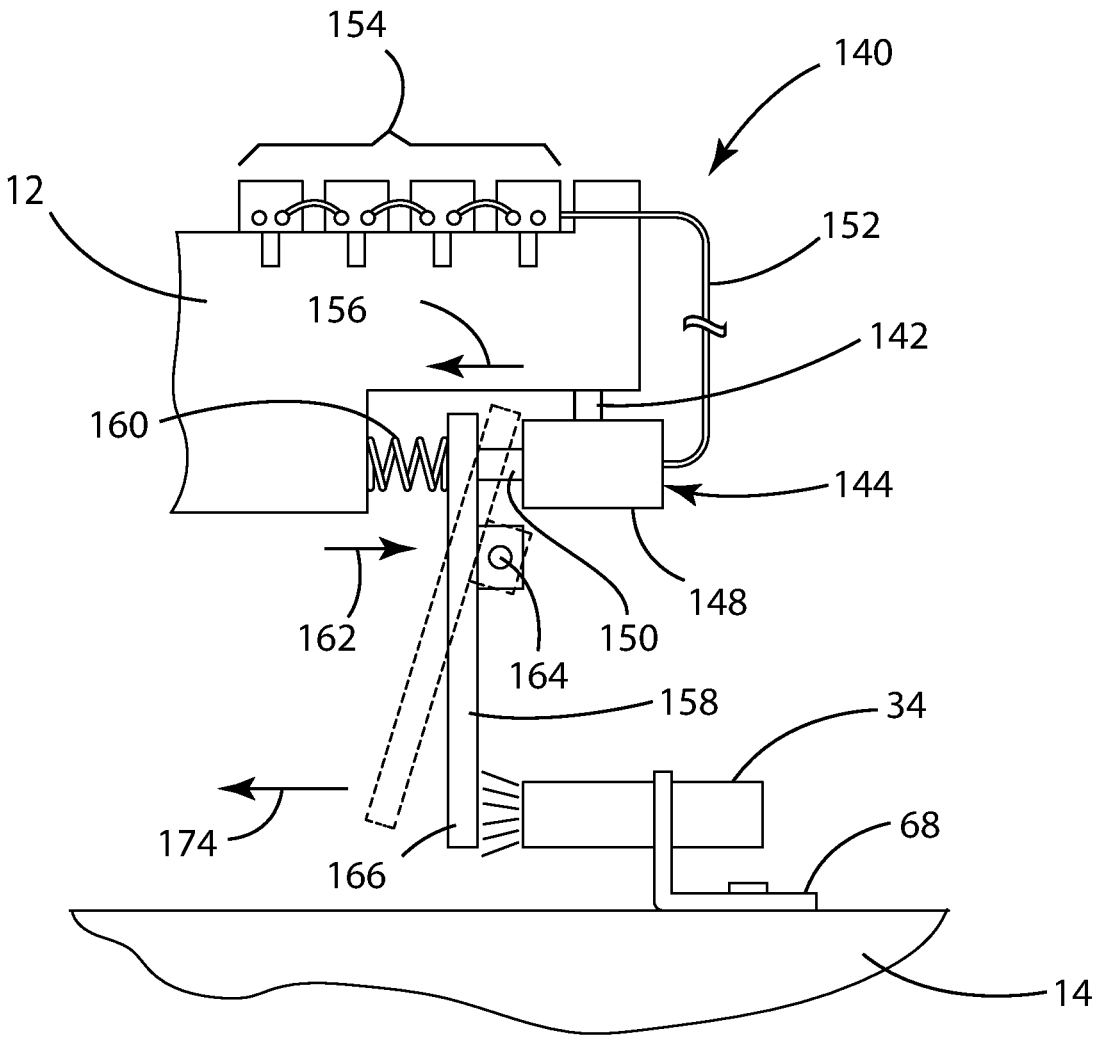
FIG. 8 is a partial schematic side view of a further embodiment of the mechanical pressure monitor system.

FIG. 8 is a partial schematic side view of a further embodiment of the mechanical pressure monitor system, seen generally at 140. The mechanical pressure monitor system 140 includes an upper die mount 142 supporting a piston-cylinder assembly 144 on an upper die 12—the piston-cylinder assembly 144 including a cylinder 148 and piston 150. The piston-cylinder assembly 144 receives pressure through a pressure line or hose 152. The pressure in the pressure line or hose 152 supplied from a pressure cylinder array 154 on the upper die 12.

The pressure in the pressure line or hose 152 applying an input to the piston-cylinder assembly 144 wherein the piston 150 generates a force 156 on a flag block 158. A spring, spring pack, or piston-cylinder assembly 160 applies a force 162 on the flag block 158 in a direction opposite that of the force 156. The force 156 applied by the piston 150 acts against the force 162 of the spring 160 to properly position the flag block 158. The spring, spring pack, or piston-cylinder assembly 160 need not be coaxial with the piston-cylinder assembly 144. In an additional example, more than one spring, spring pack, or piston-cylinder assembly 160 could be used.

A pivot pin 164 pivotally mounts the flag block 158 on the upper die 12. In an equilibrium position, wherein the respective forces 156, 162 counterbalance one another and position the flag block 158 in a predetermined and stationary, static, equilibrium position, with an end 166 of the flag block 158 positioned adjacent a sensor 34 mounted by a bracket 68 to a lower die 14.

A drop in pressure in the cylinder array 154 reduces the force 156 acting on the flag block 158 causing the spring, spring pack, or piston-cylinder assembly 160 to push the end of the flag block 158 adjacent the piston-cylinder assembly 144 closer to the piston-cylinder assembly 144 and moving the distal end 166 of the flag block 158 outwardly in the direction of the arrow 174 away from the sensor 34. The outward movement, shown in dotted lines in FIG. 8, occurs in the direction of the arrow 174. The sensor 34 senses movement of the flag block 158 and sends a signal indicating a pressure drop in the cylinder array 154.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A die assembly comprising:

a movable die component;

a first pressure source acting on and moving the movable die component;

a pressure monitoring system, including a first piston-cylinder assembly coupled to the first pressure source and a second piston-cylinder assembly coupled to a second pressure source;

the first piston-cylinder assembly including a piston engaging a flag block and operative to move the flag block independently of the moveable die component and the second piston-cylinder assembly including a piston engaging the flag block and operative to move the flag block independently of the moveable die component; and a sensor, the sensor detects a movement of the flag block.

2. The die assembly of claim 1 wherein the first pressure source includes a plurality of gas cylinders piped together in a first cylinder array with a first array pressure line connecting the pressure monitoring system to the first pressure source.

3. The die assembly of claim 1 wherein the second pressure source includes a plurality of gas cylinders piped together in a second cylinder array with a second array pressure line connecting the pressure monitoring system to the second pressure source.

4. The die assembly of claim 1 wherein the pressure monitoring system includes a mount, the flag block mounted for reciprocal movement on the mount between the first piston-cylinder assembly and the second piston-cylinder assembly.

5. The die assembly of claim 4 wherein the piston of the first piston-cylinder assembly engages a side of the flag block and the piston of the second piston-cylinder assembly engages an opposite side of the flag block such that the first piston-cylinder assembly and the second piston-cylinder assembly generate opposing forces on the flag block.

6. The die assembly of claim 1 wherein the die assembly includes an upper die and a lower die, the pressure monitoring system on the upper die and the sensor on the lower die.

7. The die assembly of claim 6 wherein the first pressure source and the second pressure source are on the upper die.

8. The die assembly of claim 1 wherein the sensor is a proximity sensor.

9. The die assembly of claim 8 including a tuning flag, the tuning flag positioned adjacent the proximity sensor.

10. The die assembly of claim 9 wherein the tuning flag includes a U-shaped member attached to the flag block.

11. A die assembly comprising:

a first pressure source acting on a first die component in an upper die wherein the first pressure source includes a first plurality of gas cylinders piped together in a first cylinder array with a first array pressure line connecting the pressure monitoring system to the first pressure source;

a pressure monitoring system, including a die mount connected to the upper die;

a first piston-cylinder assembly coupled to the first pressure source and supported by the die mount;

a second pressure source acting on a second die component in the upper die, the second pressure source includes a second plurality of gas cylinders piped together in a second cylinder array with a second array pressure line connecting the pressure monitoring system to the second pressure source;

a second piston-cylinder assembly coupled to the second pressure source and supported by the die mount;

a flag block positioned between the first piston-cylinder assembly and the second piston-cylinder assembly;

a piston of the first piston-cylinder assembly contacting the flag block and a piston of the second piston-cylinder assembly contacting the flag block wherein a force applied on one side of the flag block by the piston of the first piston-cylinder assembly and a force applied on the opposite side of the flag block by the piston of the second piston-cylinder assembly maintains the flag block in equilibrium when the pressure in both the first pressure source and the second pressure source remains constant wherein a pressure change in one of the first pressure source or the second pressure source moves the flag block independent of first die component, second die component, or upper die movement; and a sensor adjacent the flag block.

12. The die assembly of claim 11 wherein the sensor is mounted to a lower die.

13. The die assembly of claim 11 wherein the sensor is a proximity sensor.

14. A die assembly comprising:

a first pressure source acting on a die component in an upper die;

a pressure monitoring system, including a die mount connected to the upper die;

a first piston-cylinder assembly coupled to the first pressure source and supported by the die mount;

a second pressure source;

a second piston-cylinder assembly coupled to the second pressure source and supported by the die mount;

a flag block positioned between the first piston-cylinder assembly and the second piston-cylinder assembly;

the first piston-cylinder assembly engaging the flag block and the second piston-cylinder assembly engaging the flag block;

a sensor adjacent the flag block;

a U-shaped tuning flag attached to the flag block, with a base portion of the U-shaped tuning flag spaced from the flag block; and the sensor is a proximity sensor positioned adjacent the base portion of the U-shaped tuning flag and to sense movement of the U-shaped tuning flag.

15. The die assembly of claim 14 wherein the first pressure source includes a first plurality of gas cylinders piped together in a first cylinder array with a first array pressure line connecting the pressure monitoring system to the first pressure source; and the second pressure source includes a second plurality of gas cylinders piped together in a second cylinder array with a second array pressure line connecting the pressure monitoring system to the second pressure source.

16. A die assembly comprising:

an upper die and a lower die, at least one of the upper die and the lower die movable to position the upper die and the lower die in a closed position;

a first pressure source acting on a die component in the upper die;

a pressure monitoring system, including a die mount connected to the upper die;

a first piston-cylinder assembly coupled to the first pressure source and supported by the die mount;

a second pressure source;

a second piston-cylinder assembly coupled to the second pressure source and supported by the die mount;

a flag block moving laterally slidably mounted for lateral movement on the die mount between the first piston-cylinder assembly and the second piston-cylinder assembly;

the first piston-cylinder assembly engaging the flag block and the second piston-cylinder assembly engaging the flag block;

a U-shaped tuning flag attached to the flag block, with a base portion of the U-shaped tuning flag spaced from the flag block;

a sensor mounted to the lower die and adjacent the flag block when the upper die and the lower die are in the closed position; and the sensor is a proximity sensor positioned adjacent the base portion of the U-shaped tuning flag and to sense lateral movement of the U-shaped tuning flag resulting from a pressure difference between the first pressure source and the second pressure source.

17. The die assembly of claim 16 wherein the first pressure source includes a first plurality of gas cylinders piped together in a first cylinder array with a first array pressure line connecting the pressure monitoring system to the first pressure source; and the second pressure source includes a second plurality of gas cylinders piped together in a second cylinder array with a second array pressure line connecting the pressure monitoring system to the second pressure source.

18. The die assembly of claim 16 wherein a piston of the first piston-cylinder assembly engages a side of the flag block and a piston of the second piston-cylinder assembly engages in an opposite side of the flag block such that the first piston-cylinder assembly and the second piston-cylinder assembly generate opposing forces on the flag block.

* * * * *